US005488550A

United States Patent [19]

Yang

[11] Patent Number: 5,488,550

[45] Date of Patent: Jan. 30, 1996

[54] MULTI PURPOSE LAMP

[76] Inventor: Jerry S. C. Yang, 8F-8, No. 20, Ta Lung Road, Taichung, Taiwan

[21] Appl. No.: 328,494

[22] Filed: Oct. 25, 1994

Related U.S. Application Data

[62] Division of Ser. No. 978,325, Nov. 18, 1992, Pat. No. 5,384,694.

[51] Int. Cl.[6] ..... F21V 7/00

[52] U.S. Cl. ..... 362/298; 362/431

[58] Field of Search ..... 362/298, 347, 362/348, 427, 431, 296

[56] References Cited

U.S. PATENT DOCUMENTS

| | | | |
|---|---|---|---|
| 3,833,804 | 9/1974 | Vesely | 362/431 |
| 4,870,548 | 9/1989 | Beachy et al. | 362/431 |
| 5,280,417 | 1/1994 | Hall et al. | 362/431 |

FOREIGN PATENT DOCUMENTS

| | | | |
|---|---|---|---|
| 702322 | 2/1941 | Germany | 362/347 |

*Primary Examiner*—Ira S. Lazarus
*Assistant Examiner*—Sara Raab
*Attorney, Agent, or Firm*—Leonard Bloom

[57] ABSTRACT

A multi-purpose lamp (10) for outdoor use provides, as desired, a function of a pagoda lamp or of a projections lamp, or of a combined pagoda-projecting lamp.

It includes a pole (101) for insertion into the ground, a support 102 mounted on the pole (101) in desired angular position, a bulb (107) within the support (102), a lens (104) mounted on the support (102) above the bulb (107), a convex-concave reflector (113) mounted within the support (102) and disposed below the bulb (107), and two shades (105, 106) mounted on the support (102). The shades (105) is a pagoda-type shade which comprises another convex-concave reflector (117), so as, when the pagoda-type shade (105) is mounted on the support (102) to provide a pagoda lamp performance, the reflectors (113, 117) form a pair of spaced-apart convex-concave parabolic reflectors substantially parallel to each other.

The shade (106) is a ring-type shade. When the ring-type shade (106) is mounted on the support (102), the lamp (10) performs as a projecting lamp. When the ring-type shade (106) is mounted on the support (102), and the pagoda-type shade (105) is mounted above the ring-type shade (106), the lamp (10) performs as a combined pagoda-projecting lamp.

At least one surface (120, 121) of at least one reflector (113, 117) may include a plurality of reflecting facets (122), hereby providing different illumination patterns.

1 Claim, 5 Drawing Sheets

MULTI PURPOSE LAMP

CROSS REFERENCE TO RELATED APPLICATION

The instant application is a divisional application of U.S. patent application Ser. No. 07/978,325, filed Nov. 18, 1992, now U.S. Pat. No. 5,384,694, the contents of which are incorporated herewith in their entirety.

FIELD OF THE INVENTION

The present invention relates to a multi-purpose lamp, and more particularly, to a multi-purpose lamp for outdoor use which can perform as a projecting lamp and/or as a pagoda lamp.

BACKGROUND OF THE INVENTION

Conventional lighting fixtures, in order to meet needs of environment to be lighted, in general include two categories of lamps: a pagoda lamp and a projecting lamp. For example, they are described in the U.S. Pat. No. 4,645,980. Both lamps are quite different and, as described, are not replaceable nor combinable. Thus, the pagoda lamp serves only for the purpose of illuminating an area on the ground, while the projecting lamp is good for illumination of an area above the ground. Another difference is that in the pagoda lamp, the light emitted is spread radially, while in the projecting lamp the light emitted is sent in one particular direction.

In order to meet the requirements of potential users, manufacturers of lighting fixtures must provide two separate types of lamp. Further more, the users, wishing to take advantage of features of the pagoda lamp and the projecting lamp, must acquire both lamps. This is costly for both the manufacturer and the user, and sometimes it would be highly desirable to provide a lamp which could be used both for smaller and larger area illumination so as light could be diffused in different directions, including areas on the ground and above the ground, i.e., to provide functions both of the pagoda lamp and the projecting lamp, in combination and separately.

SUMMARY OF THE INVENTION

In an attempt to overcome disadvantages of the prior art, the present invention provides a multi-purpose lamp, which would, depending upon the user's intention, perform as a pagoda lamp and/or as a projecting lamp.

It is, therefore, an object of the present invention to provide a multi-purpose lighting fixture which can serve as a pagoda lamp and a projection lamp, performing in combination or separately.

It is another object of the present invention to provide a flexible lighting fixture which can be easily changed in order to alter the performance.

It is further another object of the present invention to provide a multi-purpose lamp which can perform as an improved pagoda lamp or improved projection lamp.

According to the present invention, a multi-purpose lamp for outdoor use comprises a pole for insertion into the ground, a support mounted on the pole, a bulb within the support, a lens mounted on the support above the bulb, and a convex-concave parabolic reflector within the support and disposed below the bulb.

The multi-purpose lamp also includes two types of lamp shades: a pagoda-type shade and a ring-type shade.

The pagoda-type shade, when mounted on the support, is spaced therefrom above the lens. The pagoda-type shade includes another convex-concave parabolic reflector, such that if the pagoda-type shade is mounted on the support, the convex-concave parabolic reflectors form a pair of spaced-apart convex-concave parabolic reflectors substantially parallel to each other.

The ring-type shade is to be mounted on the support for circumferential focusing of the light emitted radially.

If desired, the pagoda-type shade can be mounted on the ring-type shade.

At least one of the convex-concave parabolic reflectors can have a plurality of reflective facets for multiple radial diffusion of the light emitted from the lamp.

The reflectors are polished or electroplated.

The pole is fluted to provide the better mechanical stability for the lamp in the ground.

The multi-purpose lamp is provided with an adjustment means for the angular adjustment of the support to the vertical axis of the pole. The adjustment means includes a gear on the pole and a cooperating arcuate gear on the support, and means for locking the gears in a selected angular position of the support relative to the vertical axis of the pole. The lamp also includes a restraining collar between the support and the pole.

Thus, the multi-purpose lamp of the present invention provides a pagoda lamp, a projecting lamp, and also combined pagoda-projecting lamp in one lighting fixture.

When the multi-purpose lamp performs as the pagoda lamp, it provides an improved pagoda lamp, which is capable of angular adjustment of the support, and also to secure the support in the selected angular position. The lamp also provides a possibility of a multiple radial diffusion of the light emitted.

When the multi-purpose lamp performs as the projecting lamp, it provides an improved projecting lamp, which is capable of circumferential focusing of the light emitted radially.

All transactions of the multi-purpose lamp are easily performed.

These and other objects of the present invention will become apparent from a reading of the following specification taken in conjunction with the enclosed drawings.

DETAILED DESCRIPTION OF THE INVENTION

Figure 1:
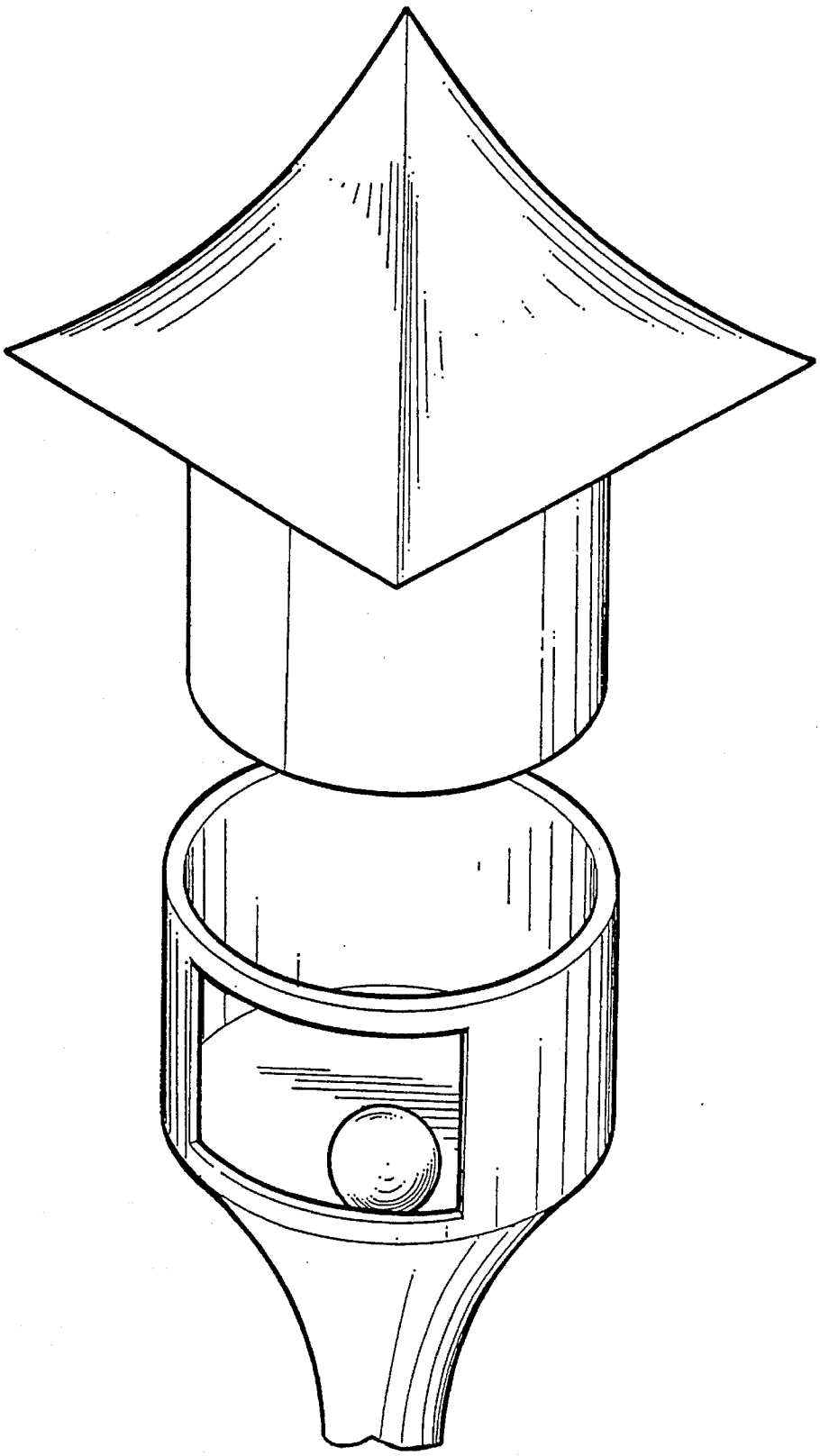
FIG. 1 PRIOR ART
FIG. 1 is a pagoda lamp of prior art.
Figure 2:
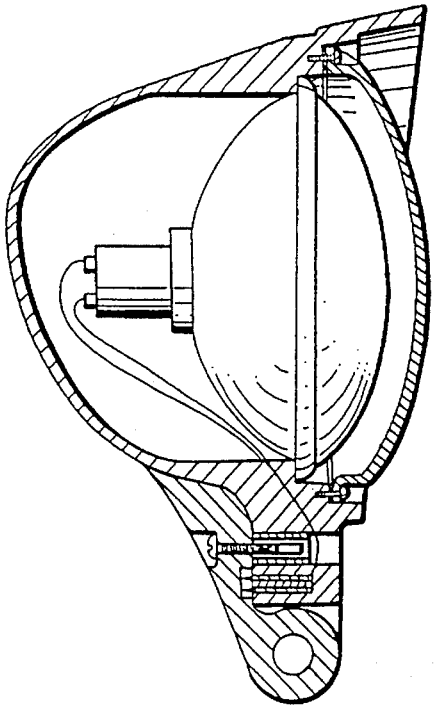
FIG. 2 PRIOR ART
FIG. 2 is a projecting lamp of prior art.
Figure 2:
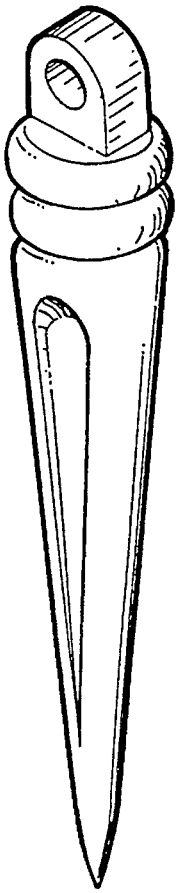
FIG. 2 PRIOR ART
Figure 3:
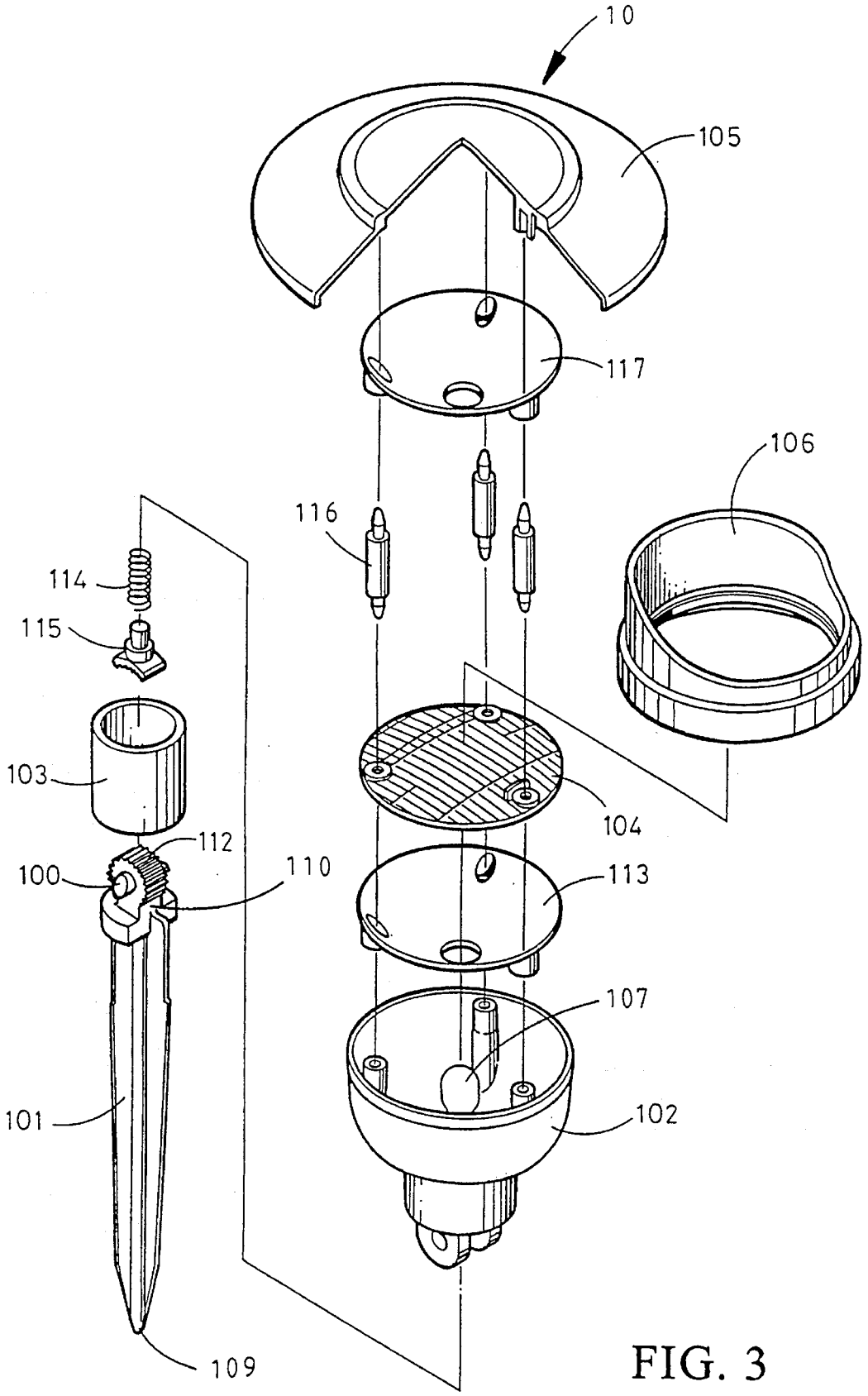
FIG. 3 is an exploded perspective view of a multi-purpose lamp according to present invention.

FIGS. 1–2 show a pagoda lamp and a projecting lamp of the prior art. Referring to FIGS. 3–6, a multi-purpose lamp 10 comprises a pole 101, a support 102 mounted on the pole 101, a bulb 107 within the support 102 and substantially enclosed therein, a lens 104 mounted on the support 102 above the bulb 107, a convex-concave parabolic reflector 113 mounted within the support 102 below the bulb 107, a pagoda-type shade 105, a ring-type shade 106, and a convex-concave parabolic reflector 117 mounted on the pagoda-type shade 105.

The pole 101 is fluted for insertion into the ground. To facilitate insertion, the pole 101 also includes a sharpened lower portion 109 and a wide upper portion 110. Its upper portion 110 is provided with a gear 100 for connection with the support 102 and for the angular adjustment of the support 102 relative to vertical axis of the pole 101. The gear 100 provides a swivel adjustment, incremental via gear teeth 112. The support 102 has a cooperating arcuate gear 115. The gear teeth 112 lock the gear 100 and the gear 115 in a selected angular position.

A restraining collar 103 is provided for casing the upper portion 110 of the pole 101 to fix up the joint between the support 102 and the pole 101.

The support 102 receives the bulb 107, socket and power cord connection (not shown), the reflector 113, a spring 114, the gear 115, the lens 104 and a shade (or shades) 105, 106. The lens 104, being mounted above the bulb 107 may include colored filter lens, thus providing light emitted from the bulb to be colored as desired.

The lamp shade can be of two types: the pagoda-type shade 105 and the ring-type shade 106. The pagoda-type shade 105 is mounted on the support 102 with the help of supporting posts 116. Another convex-concave parabolic reflector 117 is mounted on the shade 105 and is disposed between the lens 104 and the shade 105.

The lamp shade can also be of a ring-type. The ring-type shade 106, being mounted on the support 102, provides circumferential focusing of the light emitted radially.

Figure 4:
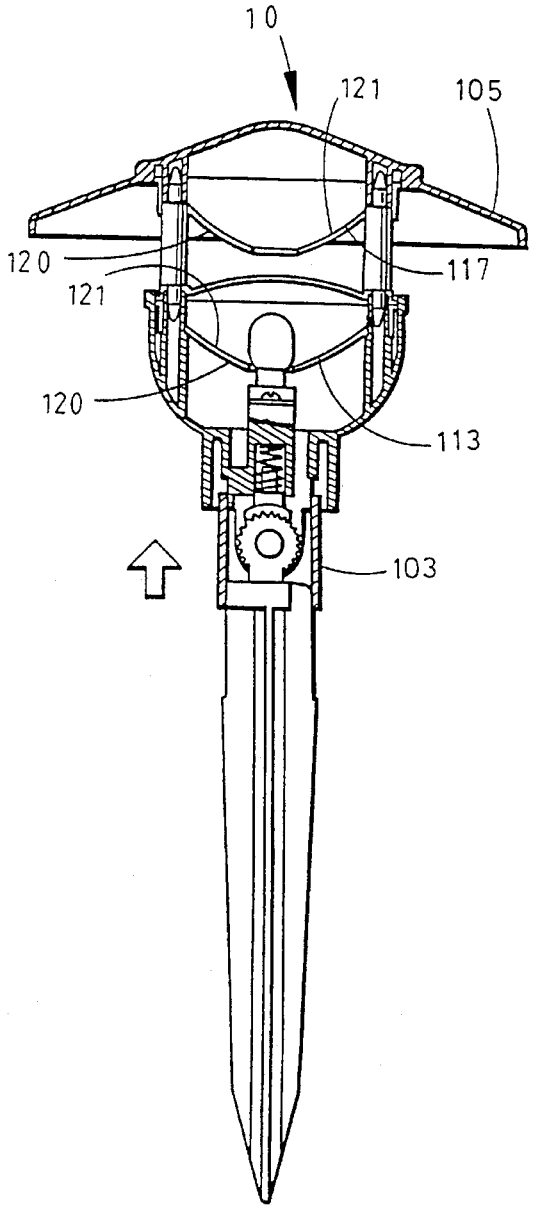
FIG. 4 is a longitudinal sectional view of FIG. 3 and shows a pagoda lamp implementation.
Figure 5:
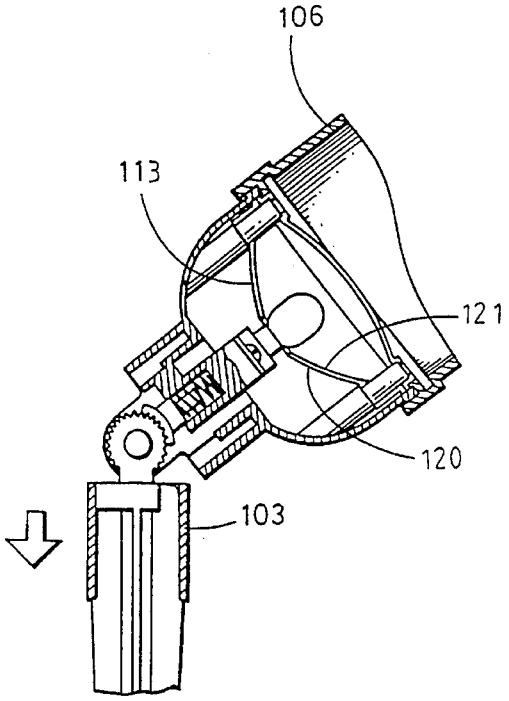
FIG. 5 is a longitudinal sectional view of FIG. 3, showing a projecting lamp according to the present invention.

Based on aforesaid elements and design, the inventor of the present invention can fabricate pagoda and projecting lamps as shown in FIGS. 4 and 5.

FIG. 4 shows the multi-purpose lamp of the present invention performing as a pagoda lamp (only the pagoda-type shade is used). As shown, in this implementation, the restraining collar 103 holds the support 102 vertically to the ground. The convex surface 120 of the reflector 117 receives the light from the bulb 107 to create a divergent pattern of the light. The concave surface 121 of the reflector 113 creates the convergent pattern of the light emitted from the bulb 107.

FIG. 5 shows the multi-purpose lamp of the present invention performing as a projecting lamp (only ring-type shade is used). Referring to FIG. 5, the restraining collar 103 is pressed down and is not engaged with the support 102. The support 102 is angled relative to the pole 101. The reflector 113 receives the light from the bulb 107 by its concave surface 121 and reflects the light in convergent pattern. The ring-type shade 106 focuses the light.

Figure 6:
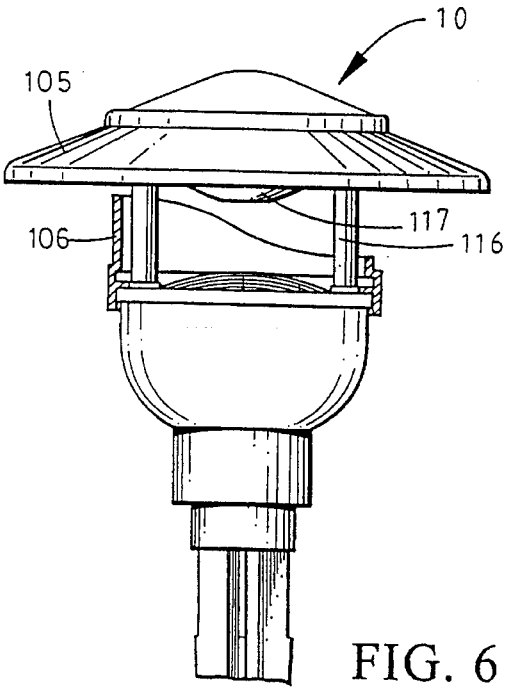
FIG. 6 is a view of the combined pagoda-projecting lamp of the present invention, along with the partial longitudinal sectional view of the ring-type shade.

When desired, the multi-purpose lamp will perform a combined function of both the pagoda and projecting lamps. FIG. 6 shows the lamp, using both types of shades 105, 106, wherein the ring-type shade 106 is mounted directly onto the support 102, the pagoda-type shade 105 is mounted on the support 102 via the supporting posts 116 above the ring-type shade 106. In this implementation, the light focused by the ring-type shade 106 is received by the convex surface 120 of the reflector 117 and reflected in divergent pattern.

The reflectors 113, 117 are polished or electroplated.

Figure 7:
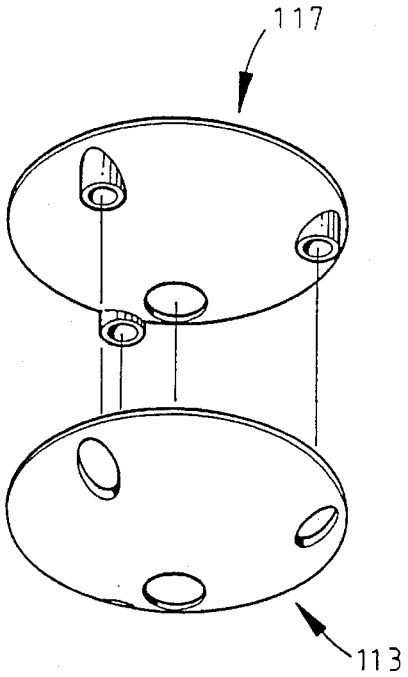
FIG. 7 is an exploded perspective view of a pair of convex-concave reflectors of the present invention.
Figure 8:
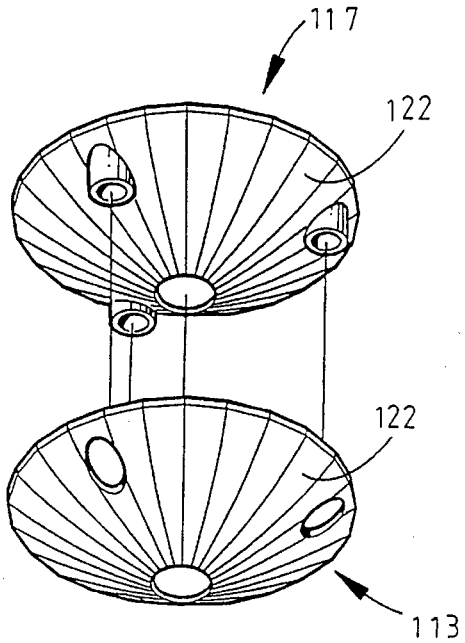
FIG. 8 is a view of the reflectors of FIG. 7, having a plurality of circumferentially-spaced facets.
Figure 9:
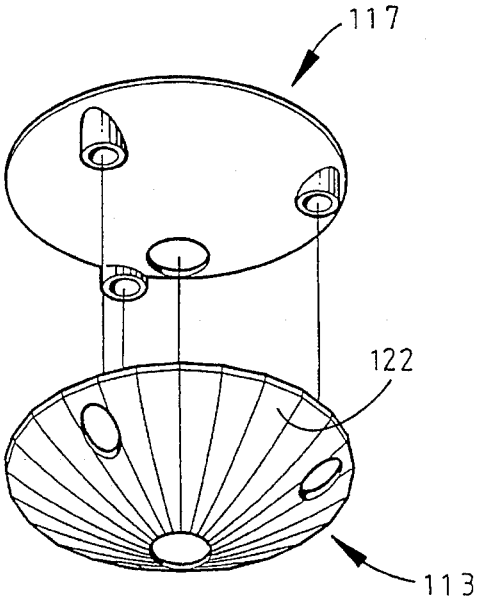
FIG. 9 is an embodiment of the present invention showing the convex surfaces of the reflectors, wherein the lower reflector has a plurality of circumferentially-spaced facets.
Figure 10:
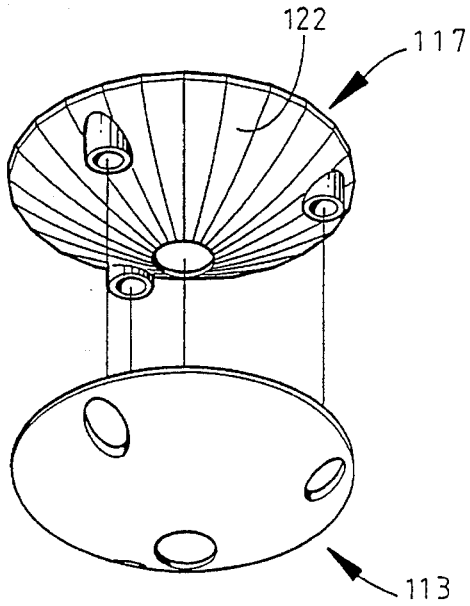
FIG. 10 is an embodiment of the present invention showing the upper reflector having a plurality of circumferentially-spaced facets.

FIGS. 7–10 show a plurality of circumferentially-spaced facets 122 on the surfaces 120, 121 of at least one of the reflectors 113, 117 provided in order to increase the variety of the light patterns. FIG. 7 shows particularly the convex-concave reflectors 113, 117 which include both convex and concave surfaces convenient for manufacturing.

Obviously, many modifications may be made without departing from the basic spirit of the present invention. Accordingly, it will be appreciated by those skilled in the art that within the scope of the appended claims, the invention may be practiced other than has been specifically described herein.

I claim:

1. A multi-purpose lamp for outdoor use, comprising a pole for insertion into the ground, a support mounted on the pole, a bulb within the support and substantially enclosed therein, a lens mounted on the support above the bulb, a convex-concave parabolic reflector mounted within the support and disposed below the bulb, and first and second shades mounted on the support and spaced therefrom above the lens.

* * * * *